US006536243B2

(12) United States Patent
Sasano

(10) Patent No.: US 6,536,243 B2
(45) Date of Patent: Mar. 25, 2003

(54) DRUM TYPE WASHING MACHINE WITH TURBIDITY SENSOR

(75) Inventor: Kiyomi Sasano, Ichinomiya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 161 days.

(21) Appl. No.: 09/730,569

(22) Filed: Dec. 7, 2000

(65) Prior Publication Data

US 2001/0002542 A1 Jun. 7, 2001

(30) Foreign Application Priority Data

Dec. 7, 1999 (JP) ..... 11-347535

(51) Int. Cl.[7] ..... D06F 33/02

(52) U.S. Cl. ..... 68/12.02; 68/12.04; 68/24; 68/140

(58) Field of Search ..... 68/12.02, 12.04, 68/25, 24, 58, 140

(56) References Cited

U.S. PATENT DOCUMENTS 2,361,235 A * 10/1944 Pick
2,615,320 A * 10/1952 Belaieff
2,963,939 A * 12/1960 Garey

FOREIGN PATENT DOCUMENTS

| | | | |
|---|---|---|---|
| DE | 0 849 390 | | 6/1998 |
| EP | 0 178 031 | | 4/1986 |
| GB | 2 068 419 | | 8/1981 |
| GB | 2 271 785 | | 4/1994 |
| JP | 60-21798 | * | 2/1985 |
| JP | 61-20317 | * | 5/1986 |
| JP | 61-59760 | * | 12/1986 |
| JP | 62-22689 | * | 1/1987 |
| JP | 62-6476 | * | 2/1987 |
| JP | 62-295693 | * | 12/1987 |
| JP | 63-29557 | * | 6/1988 |
| JP | 63-197493 | * | 8/1988 |
| JP | 2-77296 | * | 3/1990 |
| JP | 2-243192 | * | 9/1990 |

* cited by examiner

*Primary Examiner*—Frankie L. Stinson
(74) *Attorney, Agent, or Firm*—Pillsbury Winthrop LLP

(57) ABSTRACT

A drum type washing machine includes an outer cabinet, a water tub mounted in the outer cabinet and having a rear wall, a generally drum-like rotating tub rotatably mounted in the water tub and having a rear wall, and a turbidity sensor sensing a turbidity of wash liquid in the water tub and disposed on a lower inside face of the rear wall of the water tub, the turbidity sensor including a light emitting element and a light detecting element.

4 Claims, 5 Drawing Sheets

DRUM TYPE WASHING MACHINE WITH TURBIDITY SENSOR

BACKGROUND OF THE INVENTION

1. Field of the Invention

This invention relates to a drum type washing machine provided with a turbidity sensor detecting a turbidity of wash liquid in an outer or water tub for determination of a soil degree of laundry or for other purposes.

2. Description of the Prior Art

Conventional automatic washing machines of the top loading type have been provided with a turbidity sensor detecting turbidity of wash liquid. For instance, U.S. Pat. No. 5,373,714 to Masatsugu Wada discloses a control device for an automatic washing machine of the top loading type provided with a turbidity sensor comprising a light emitting element and a light detecting element. The turbidity sensor is disposed in a drain hole through which wash liquid is discharged out of a water-receiving tub. The turbidity sensor detects a turbidity of the wash liquid flowing between a light emitting face and a light detecting face. The washing operation is controlled on the basis of the results of detection by the turbidity sensor. For example, the results of detection by the turbidity sensor are used to determine a degree of soil of laundry. A time period of the wash step is controlled on the basis of the determined soil degree.

Provision of the turbidity sensor has recently been proposed for drum type washing machines. The drum type washing machines comprise a water tub having a front opening and a drum-like rotating tub rotatably mounted in the water tub and having a front wall with an opening and a circumferential wall with a multitude of through holes. The drum type washing machine is usually controlled so as to carry out an automatic washing course in which wash, intermediate dehydration, rinse and final dehydration steps are automatically executed sequentially.

In the automatic washing machines of the top loading type, the wash liquid in the drain hole is substantially clear except in a draining operation. However, water scale, detergent component, etc. tend to easily adhere to the light emitting and detecting faces of the turbidity sensor during the drainage, whereupon the detection accuracy is reduced. Accordingly, it is difficult to employ the disposition of the turbidity sensor in the washing machine of the top loading type also in the drum type washing machine.

SUMMARY OF THE INVENTION

Therefore, an object of the present invention is to provide a drum type washing machine in which the turbidity of the wash liquid is detected by the turbidity sensor comprising the light emitting and detecting elements, the washing operation is controlled on the basis of the result of detection by the turbidity sensor, and a reduction in the detection accuracy of the turbidity sensor can be prevented.

The present invention provides a drum type washing machine comprising an outer cabinet, a water tub provided in the outer cabinet so as to be inclined downwardly rearward and having a rear wall, a generally drum-like rotating tub rotatably mounted in the water tub and having a rear wall, and a turbidity sensor detecting a turbidity of wash liquid in the water tub and disposed on a lower inside face of the rear wall of the water tub, the turbidity sensor including a light emitting element and a light detecting element.

According to the above-described construction, the turbidity sensor comprises the light emitting element and the light detecting element. Consequently, a cost reduction and simplification of the construction can be achieved. Further, the turbidity sensor is disposed on the lower inside face of the rear wall of the water tub such that the light emitting face and the light detecting face are located in the wash liquid in the water tub. That is, since the turbidity sensor directly detects the turbidity of the wash liquid in the water tub, the turbidity can be detected reliably and accurately. Additionally, since the wash liquid flows between the light emitting element and the light detecting element with rotation of the rotating tub, an amount of water scale, detergent component, etc. adherent to the light emitting and detecting faces is reduced and accordingly, a reduction in the detection accuracy can be prevented.

In a first preferred form, the turbidity sensor is disposed so as to be opposed to the rear wall of the rotating tub. Upon rotation of the rotating tub, a water flow is produced in a space between the rear walls of the water tub and the rotating tub. Particularly, a water flow is produced in the space where the rear walls of the water tub and the rotating tub are opposed to each other. This water flow has a higher flow speed than a water flow produced in a space defined between the inner face of the rear wall of the water tub and the circumference of the rear wall of the rotating tub. Consequently, since water scale and detergent component adherent to the light emitting and detecting faces are washed away by the water flow and accordingly, the detection accuracy of the turbidity sensor can further be prevented from being reduced.

Additionally, the water tub and the rotating tub are disposed to be inclined rearwardly downward. In this construction, the turbidity sensor is disposed in a dead space between a lower portion of the rear wall of the water tub and the outer cabinet. Consequently, the dead space can effectively be used.

In a first preferred form, the lower inside face of the rear will of the water tub is formed with a hollow outward protrusion in which the turbidity sensor is disposed. Consequently, a distance between the rear walls of the water tub and the rotating tub can be prevented from being increased.

In a second preferred form, the outer cabinet has a rear wall with an inspection hole formed therethrough so as to correspond to the turbidity sensor and with a lid mounted thereon so as to close and open the inspection hole, and the turbidity sensor is detachably attached through the inspection hole to the rear wall of the water tub. Consequently, the turbidity sensor can easily be inspected and repaired.

In a third preferred form, the turbidity sensor is located on the rear wall of the water tub so as to be circumferentially displaced from a lowest portion of the rear wall of the water tub, and wherein the turbidity sensor carries out a detecting operation when the rotating tub is rotated in the direction of displacement of the turbidity sensor. Upon rotation of the rotating tub, the wash liquid in the wash tub is centrifugally caused to rise in the rotational direction of the rotating tub such that the water level at the side in the water tub opposite to the direction of rotation of the rotating tub is decreased, and an amount of bubble is increased. Consequently, the turbidity of the wash liquid can be detected accurately and reliably.

In a fifth preferred form, the water tub and the rotating tub are disposed to be inclined rearwardly downward. In this construction, the turbidity sensor is disposed in a dead space between a lower portion of the rear wall of the water tub and the outer cabinet. Consequently, the dead space can effectively be used.

BRIEF DESCRIPTION FO THE DRAWINGS

Other objects, features and advantages of the present invention will become clear upon reviewing the following description of the preferred embodiment, made with reference to the accompanying drawings, in which.

DETAILED DESCRIPTION OF THE PREFERRED EMBODIMENT

Figure 1:
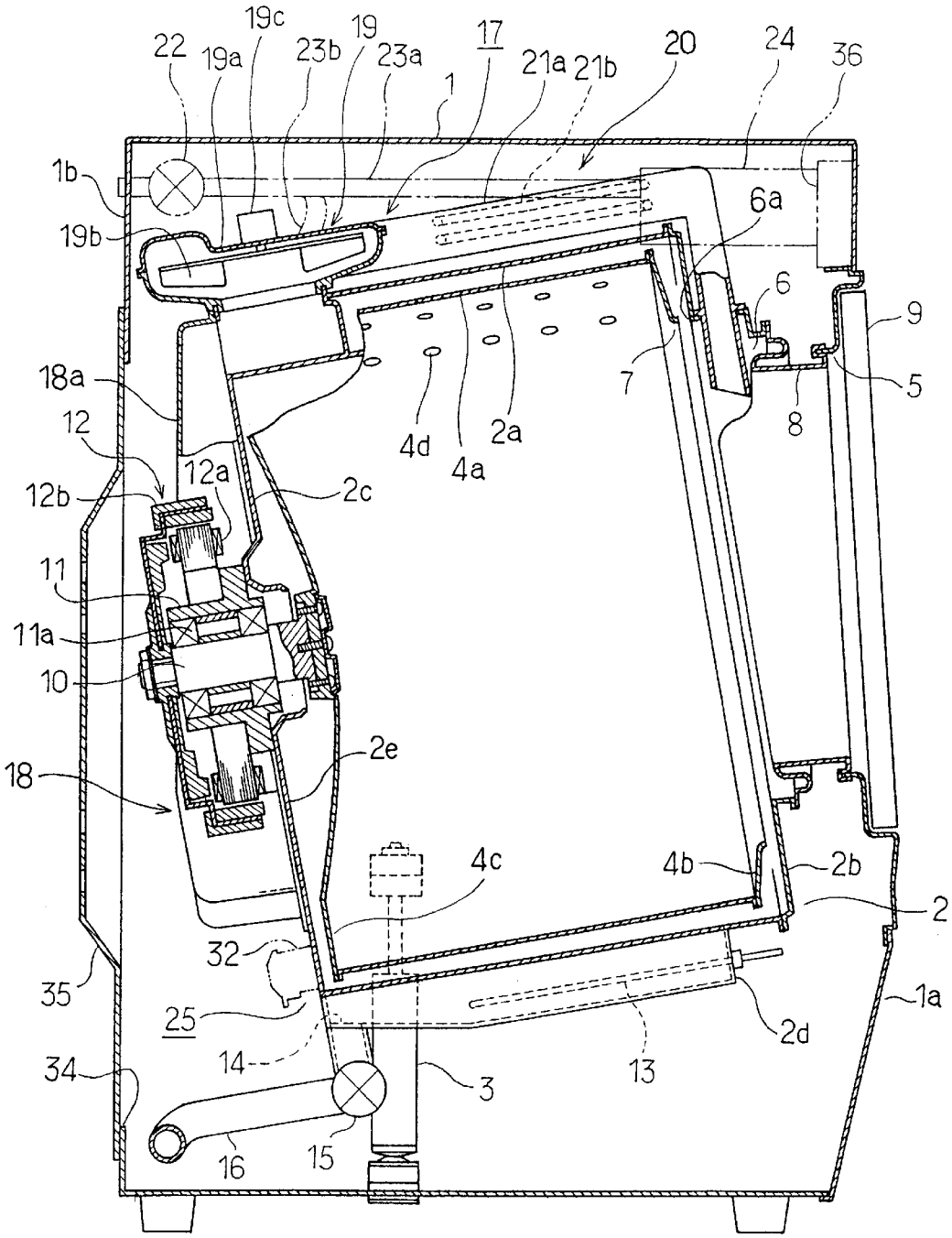
FIG. 1 is a longitudinal side section of a drum type washing machine of one embodiment in accordance with the present invention.
Figure 2:
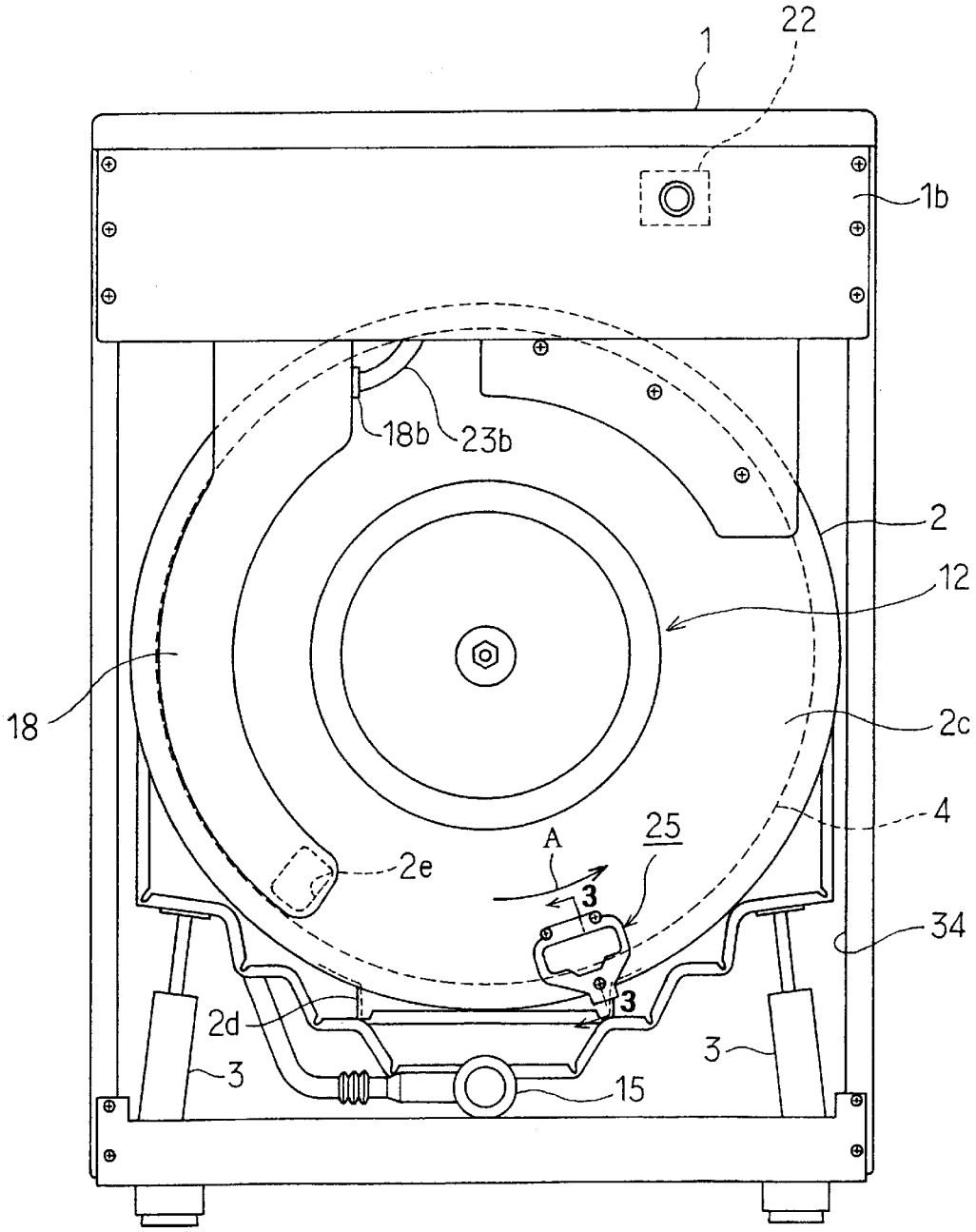
FIG. 2 is a rear view of the drum type washing machine with a rear panel being removed from the outer cabinet.
Figure 3:
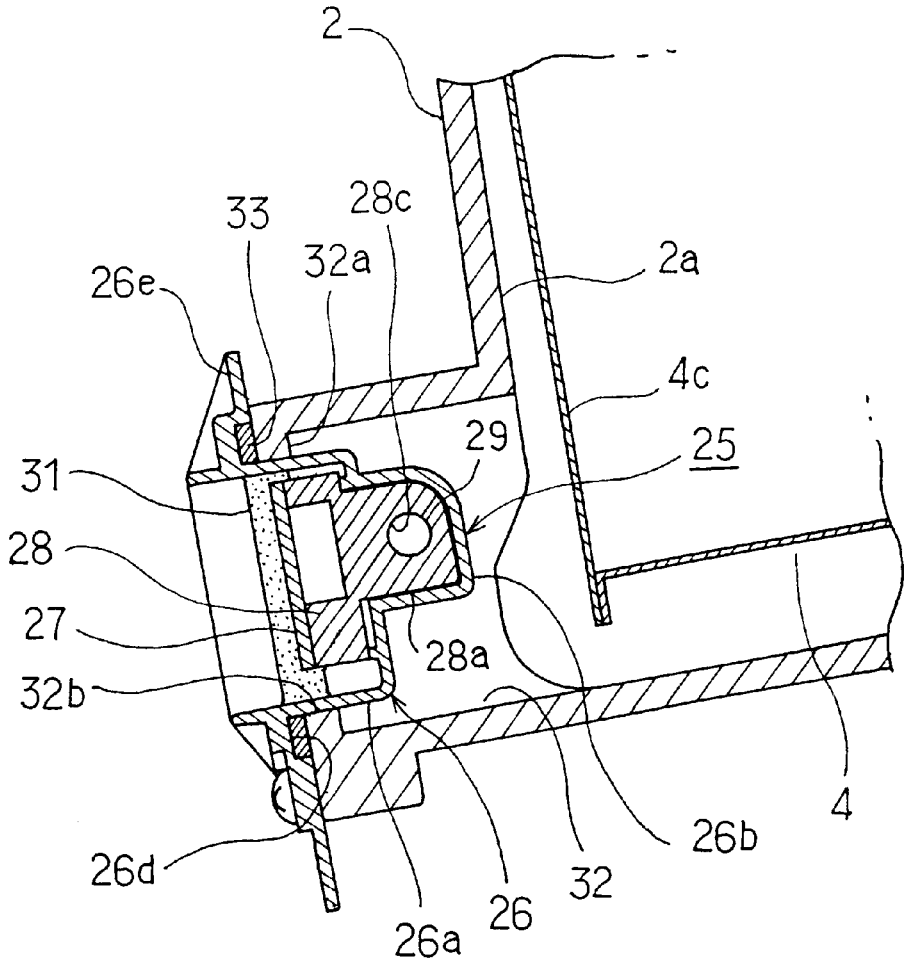
FIG. 3 is a sectional view taken along line 3—3 in FIG. 2, showing the turbidity sensor.
Figure 4:
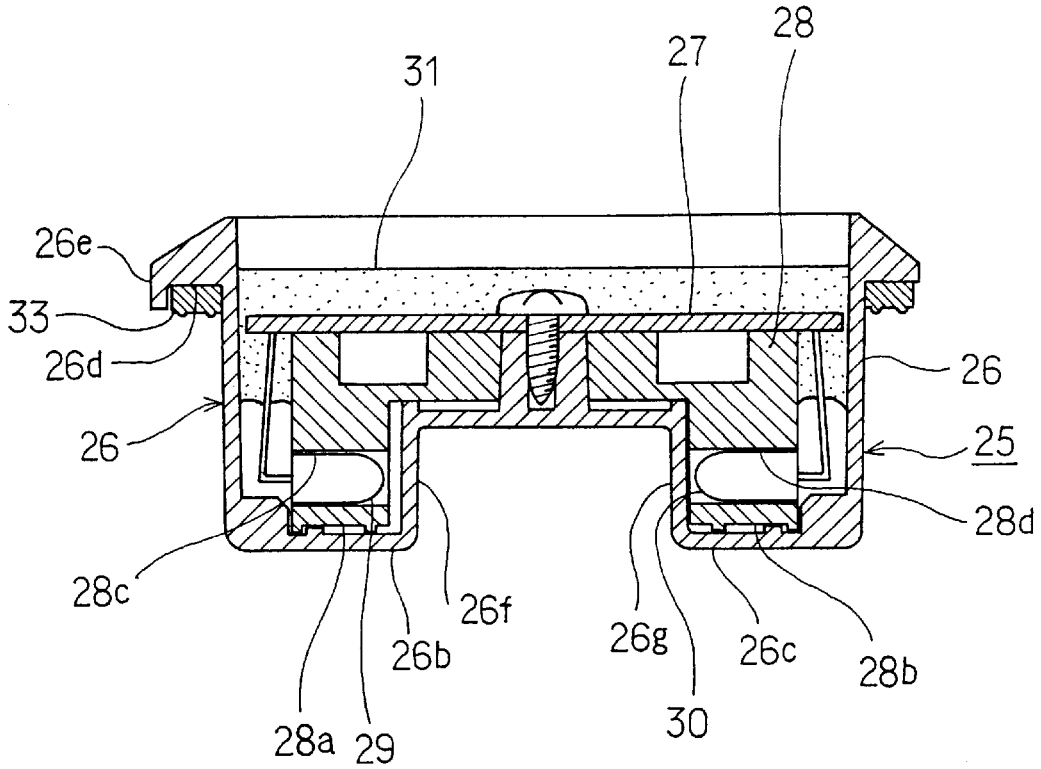
FIG. 4 is a transversely sectional plan view of the turbidity sensor.
Figure 5:
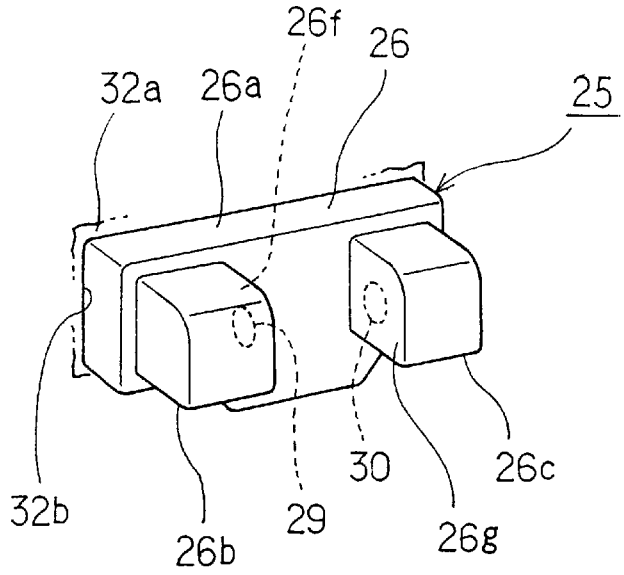
FIG. 5 is a perspective view of the turbidity sensor.
Figure 6:
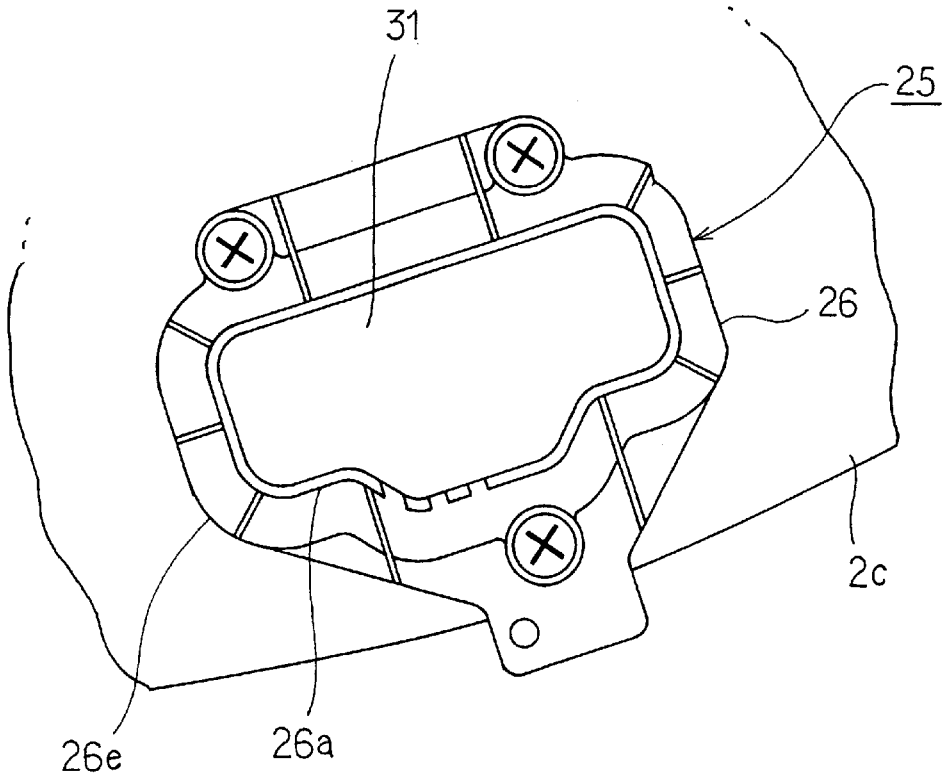
FIG. 6 is a rear view of the turbidity sensor.

One embodiment of the present invention will be described with reference to the accompanying drawings. In the embodiment, the invention is applied to a drum type washing machine with a drying function. Referring to FIGS. 1 and 2, the overall construction of the washing machine is shown. The washing machine comprises a rectangular box-shaped outer cabinet 1 and a generally drum-like water tub 2 provided in the cabinet so as to be inclined rearwardly downward. The water tub 2 comprises a circumferential wall 2*a,* a front wall 2*b* and a rear wall 2*c.* The water tub 2 is supported by two pairs of elastic supporting mechanisms 3. A generally drum-like rotating tub 4 is rotatably mounted in the water tub 2. The rotating tub 4 is inclined rearwardly downward substantially at the same inclination as the water tub 2. The rotating tub 4 comprises a circumferential wall 4*a,* a front wall 4*b,* a rear wall 4*c.* The circumferential wall 4*a* has a multitude of through holes 4*d* through which air and wash liquid are caused to flow. Accordingly, the rotating tub 4 serves as a wash tub, dehydration tub and drying tub.

A front wall la of the cabinet 1 and the front walls 2*b* and 4*b* of the tubs 2 and 4 have openings 5, 6 and 7 respectively. The openings 5 and 6 are water-tightly connected together by bellows 8 made of an elastic material. A door 9 is mounted on the front wall la of the cabinet 1 so as to close and open the opening 5. An electric motor 12 of the outer rotor type is mounted on a substantially central portion of the rear wall 2*c* of the water tub 2. More specifically, a bearing housing 11 is mounted on a substantially central portion of the rear wall 2*c* of the water tub 2. A rotational shaft 10 is rotatably mounted on a bearing 11*a* further mounted on the bearing housing 11. The motor 12 includes a stator 12*a* fixed to an outer circumference of the bearing housing 11. The rotational shaft 10 has a front end extending through a hole (not shown) of the rear wall 2*c* of the water tub 2 to be fixed to a central portion of the rear wall 4*c* of the rotating tub 4. The shaft 10 further has a rear end on which a rotor 12*b* of the motor 12 is mounted. Thus, the rotating tub 4 is directly driven by the motor 12. The water tub 2 has an outwardly protruding convex portion 2*d* formed integrally on the lowest portion of the circumferential wall 2*a.* A heating element 13 is provided in the convex portion 2*d* to heat wash liquid. The convex portion 2*d* has a drain hole 14 formed in the rear bottom thereof. A drain valve 15 and a drain pipe 16 are connected to the drain hole 14. The drain pipe 16 is not shown in FIG. 2.

A drier 17 is mounted over the rear wall 2*c,* top and upper front wall of the water tub 2. The drier 17 is provided for drying laundry in the rotating tub 4. More specifically, the drier 17 comprises a dehumidifier 18 mounted on the rear wall 2*c* of the water tub 2. The dehumidifier 18 includes a duct 18*a* mounted on the rear wall 2*c* of the water tub 2. The rear wall 2*c* includes a portion corresponding to a lower portion of the duct 18*a.* A vent hole 2*e* which also serves as a water outlet is formed in the portion of the rear wall 2*c.* A water inlet 18*b* is formed in an upper side of the duct 18.

A fan 19 is mounted on a rear portion of the top of the water tub 2. The fan 19 comprises a casing 19*a,* a centrifugal fan 19*b* and a fan motor 19*c* fixed on an outer wall of the casing 19*a* to drive the centrifugal fan 19*b.* An upper end of the duct 18*a* of the dehumidifier 18 communicates with an inlet side of the casing 19*a.* Further, a heater 20 is mounted on a front portion of the top of the water tub 2. The heater 20 comprises a duct 21*a* and a heating element 21*b* disposed in the duct. The duct 21*a* has a rear end connected to an outlet side of the casing 19*a* of the fan 19. The water tub 2 has a hot air outlet 6*a* formed in the circumference of the hole 6. The duct 21*a* has a front end connected to the hot air outlet 6*a.* The dehumidifier 18, fan 19 and heater 20 constitute the drier 17.

A water-supply valve 22 is mounted in an upper rear interior of the cabinet 1. A water-supply vessel 24 is mounted in an upper front interior of the cabinet 1. The vessel 24 is provided with a detergent dispenser (not shown) etc. therein. The water-supply valve 22 has one water inlet and two water outlets although none of them are shown. The water inlet is connected to a water service. One of the water outlets is connected via a pipe 23*a* to the vessel 24. The other water outlet is connected via a pipe 23*b* to a water inlet 18*b* of the dehumidifier 18.

The water outlet of the water-supply valve 22 connected to the pipe 23*a* is opened in a wash and rinse steps of the washing operation so that water is supplied via the vessel 24 into the water tub 2. On the other hand, the water outlet of the valve 22 connected to the pipe 23*b* is opened in a drying operation so that a predetermined small amount of water is supplied via the water inlet 18*b* into the duct 18*a.* Further, the drier 17 is driven in the drying operation. More specifically, the fan motor 19*c* of the fan 19 is driven to rotate the centrifugal fan 19*b,* and the heating element 21*b* of the heater 20 is energized to generate heat. Damp air in the rotating tub 4 is then drawn through the holes 4*d* and a vent hole 2*e* into the duct 18*a* of the dehumidifier 18. The drawn air is then caused to flow through the casing 19*a* and the duct 21*a* in turn to be returned through the hot air outlet 6*a* into the rotating tub 4 and accordingly into the water tub 2. As the result of the aforesaid circulation, air in the rotating tub 4 is rendered hot and dehumidified by heat exchange, whereupon laundry in the rotating tub 4 is dried.

Referring to FIG. 2, a turbidity sensor 25 is provided on a lower inside face of the rear wall 2*c* of the water tub 2 for detecting a turbidity of wash liquid in the water tub 2. The turbidity sensor 25 is located to be displaced circumferentially relative to a lowest portion of the rear wall 2*c* of the water tub 2, or more specifically, in the direction of arrow A in FIG. 2. The turbidity sensor 25 comprises a photosensor of the light transmittance type. Referring to FIGS. 3 to 6, the turbidity sensor 25 includes a casing 26 made of a light transmissible material, for example, a transparent plastic.

The casing 26 includes a body accommodating section 26*a* and two element accommodating sections 26*b* and 26*c* extending from the front of the body accommodating section so as to be opposed away from each other. The body accommodating section 26*a* has an open rear end. A flange 26*e* is formed along the outer periphery of the rear end. The flange 26*e* has a packing accommodating section 26*d*.

A circuit board 27 is screwed in the body accommodating section 26*a*. An element support 28 having two element mounting portions 28*a* and 28*b* is screwed to the circuit board 27. The element mounting portions 28*a* and 28*b* are disposed in the element accommodating sections 26*b* and 26*c* respectively whereas the other portion of the element support 28 is disposed in the body accommodating section 26*a*. The element mounting portions 28*a* and 28*b* have respective holes 28*c* and 28*d* extending in the direction in which the element mounting portions are opposed to each other. A light emitting element 29 comprising a light emitting diode, for example, is disposed in the hole 28*c*. A light detecting element 30 comprising a phototransistor, for example, is disposed in the hole 28*d*. Accordingly, the light emitting and detecting elements 29 and 30 are opposed to and spaced away from each other. Opposed faces of the element accommodating sections 26*b* and 26*c* thus serve as light emitting and detecting faces respectively. The opposed faces will be referred to as "light emitting face 26*f* and light detecting face 26*g*" respectively. See FIG. 4. The light emitting element 29 and the light detecting element 30 are electrically connected to the circuit board 27. For example, a plastic filling material 31 fills the interior of the casing 26 around the circuit board 27, thereby providing electrical insulation and waterproof for the interior of the casing 26.

A convex portion 32 protruding outward is formed on a lower portion of the rear wall 2*c* of the water tub 2 as shown in FIGS. 1 and 2. The convex portion 32 is located to be displaced circumferentially relative to a lowest portion of the rear wall 2*c* of the water tub 2, or more specifically, in the direction of arrow A in FIG. 2. The convex portion 32 has a sensor insertion hole 32*b* formed in a rear end thereof. The turbidity sensor 25 is fitted into the sensor insertion hole 32*b* from the rear of the convex portion 32 so that the body and element accommodating sections 26*a*, 26*b* and 26*c* of the casing 26 are located in the convex portion. A packing 33 is accommodated in the packing accommodating section 26*d* and the flange 26*e* is then screwed to the rear end 32*a* of the convex portion 32, whereupon the turbidity sensor 25 is mounted on the water tub 2 so that the sensor is opposed to the rear wall 4*c* of the rotating tub 4 and so that the light emitting and detecting elements 29 and 30 are circumferentially opposed to each other.

A generally rectangular inspection hole 34 is formed in the rear wall 1*b* of the cabinet 1 as shown in FIG. 2. A rear lid 35 is detachably mounted on the rear wall 1*b* so as to close the inspection hole 34 as shown in FIG. 1. The inspection hole 34 is sized to be enough for an inspector to see the drain valve 15, turbidity sensor 25 and motor 12 therethrough. Accordingly, the turbidity sensor 25 can easily be inspected and repaired since it is attached to and detached from the convex portion 32 through the inspection hole 34.

A control device 36 is mounted on an upper inside face of the front wall la of the cabinet 1. The control device 36 comprises a microcomputer (not shown) storing a control program for controlling the washing operation and the drying operation. Based on the results of detection by the turbidity sensor 25, the control device 36 sets a time period of the wash step in the washing operation, the number of execution of the rinse step, etc.

The operation of the drum type washing machine will now be described. In execution of the wash step of the washing operation, the outlet of the water-supply valve 22 is firstly opened so that water is supplied via the pouring vessel 24 into the water tub 2 together with detergent. The supply of detergent is completed at an early stage of the water supply and thereafter, only the water is supplied into the water tub 2. Part of the wash liquid supplied into the water tub 2 flows into the convex portion 32. Since the water tub 2 is inclined rearwardly downward in the embodiment, the wash liquid easily flows into the convex portion 32.

When a predetermined water level is reached in the water tub 2, the outlet of the water-supply valve 22 is closed so that the water supply is ended. The heating element 13 is then energized in order that the wash liquid in the water tub 2 may be heated. The rotating tub 4 is successively rotated at a low speed repeatedly alternately in the normal and reverse directions or in the direction of arrow A and in the direction opposite arrow A in FIG. 2. A water flow is produced in a space between the rear wall 2*c* of the water tub 2 and the rear wall 4*c* of the rotating tub 4. Particularly, a water flow is produced in the space where the rear walls 2*c* and 4*c* of the water tub 2 and the rotating tub 4 are opposed to each other. This water flow has a higher flow speed than a water flow produced in a space defined between the inner face of the rear wall 2*c* of the water tub 2 and the circumference of the rear wall 4*c* of the rotating tub 4. Consequently, the wash liquid forcibly flows into the convex portion 32. portion 32.

The control device 36 then sets a time period of the wash step based on the results of detection by the turbidity sensor 25 at the time when a predetermined period of time expires from the start of rotation of the rotating tub 4. Particularly in the embodiment, the control device 36 sets the time period of the wash step based on the results of detection by the turbidity sensor 25 when the rotating tub 4 is rotated in the direction of arrow A in FIG. 2.

The detection by the turbidity sensor 25 will now be described. Light emitted from the light emitting element 29 passes through the light emitting face 26*f* of the element accommodating section 26*b*. After passing through the wash liquid, the light is detected via the light detecting face 26*g* of the element accommodating section 26*c* by the light detecting element 30. In this case, an amount of light detected by the light detecting element 30 or a light intensity changes according to a turbidity of the wash liquid. Changes in the turbidity of the wash liquid according to a degree of soil of laundry have experimentally been confirmed. Accordingly, a soil degree of laundry can be detected by measuring an amount of light detected or received by the light detecting element 30. When the time period of the wash step is set on the basis of the results of detection by the soil sensor 25, the time period of the wash step can be set at a value suitable for the soil degree of laundry.

Upon completion of the wash step, an intermediate dehydration step is carried out for a predetermined period of time. In the intermediate dehydration step, the rotating tub 4 is rotated in one direction at high speeds while the drain valve 15 is closed. The rinse step is carried out upon completion of the intermediate dehydration step. In the rinse step, the outlet of the water-supply valve 22 is opened so that a predetermined amount of water is supplied into the water tub 2. Thereafter, the water is heated by the heating element 13. Part of the water in the water tub 2 flows into the convex portion 32. The rotating tub 4 is then rotated at a low speed repeatedly alternately in the normal and reverse directions. In this case, too, the detection by the turbidity sensor 25 is carried out when the rotating tub 4 is rotated in the direction of arrow A in FIG. 2 after start of rotation. The number of times of the rinse step is set at a suitable value on the basis of the results of detection by the turbidity sensor 25.

A final dehydration step is carried out when the rinse step is executed at the set number of times. In the final dehydration step, the rotating tub 4 is rotated at a high speed in one direction while the drain valve 15 is opened. The final dehydration step is carried out for a predetermined period of time. A drying step is carried out upon completion of the final dehydration step. The drier 17 is operated in the drying step. The drying step is carried out for a predetermined period of time.

According to the above-described construction, the turbidity sensor 25 is disposed on the inside face of the rear wall 2*c* of the water tub 2 so as to directly detect the transmittance of the wash liquid in the water tub 2. Consequently, the soil degree of laundry can be detected reliably and accurately. Further, the wash liquid flows between the light emitting face 26*f* and the light detecting face 26*g* of the turbidity sensor 25. Consequently, since an amount of water scale, detergent component, etc. adherent to the light emitting and detecting faces 26*f* and 26*g* is reduced, a reduction in the detection accuracy can be prevented.

The convex portion 32 is formed on the lower portion of the rear wall 2*c* opposed to the rear wall 4*c* of the water tub 4. The turbidity sensor 25 is disposed in the convex portion 32. When the water flow is produced during rotation of the rotating tub 4, the wash liquid forcibly flows into the convex portion 32, passing between the light emitting face 26*f* and light detecting face 26*g* of the turbidity sensor 25. Accordingly, even if water scale or detergent component adheres to the light emitting face 26*f* and/or the light detecting face 26*g*, these are washed away by the flow of wash liquid. Consequently, the detection accuracy of the turbidity sensor 25 can further be prevented from being reduced. Further, the provision of the turbidity sensor 25 on the rear wall 2*c* of the water tub 2 does not increase the distance between the rear walls 2*c* and 4*c* of the tubs 2 and 4. Consequently, the depth of the water tub 2 can be prevented from being increased and the depth of the rotating tub 4 can be prevented from being reduced, whereupon a reduction in the washing capacity can be prevented.

Upon rotation of the rotating tub 4, the wash liquid in the wash tub 2 is centrifugally caused to rise in the rotational direction of the rotating tub such that the water level at the side in the water tub opposite to the direction of rotation of the rotating tub is decreased, and an amount of bubble is increased at the side. The transparency of the wash liquid cannot be detected accurately when the turbidity sensor is disposed in such an area where the water level is low and many bubbles are present. In the above-described construction, however, the turbidity sensor 25 is located on the rear wall 2*c* of the water tub 2 so as to be circumferentially displaced from the lowest portion of the rear wall, and the turbidity sensor 25 carries out a detecting operation when the rotating tub 4 is rotated in the direction of displacement of the turbidity sensor. Consequently, the turbidity of the wash liquid can be detected accurately and reliably by the turbidity sensor 25.

Although the turbidity sensor 25 is disposed in the convex portion 32 formed on the rear wall 2*c* of the water tub 2 in the foregoing embodiment, the sensor may be disposed in a lower interior of the duct 18*a* of the dehumidifier 18, instead. The wash liquid flows through the vent hole 2*e* into the duct 18*a* in the wash and rinse steps. Accordingly, the turbidity of the wash liquid can be detected by the aforesaid alternate construction.

Only the casing 26 of the turbidity sensor 25 may be transparent or translucent. Further, a rotational speed of the rotating tub 4 may be controlled or the timing for finish of the rinse step may be determined on the basis of the results of detection by the turbidity sensor 25.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A drum type washing machine comprising:

an outer cabinet;

a water tub provided in the outer cabinet so as to be inclined downwardly rearward and having a rear wall;

a generally drum-like rotating tub rotatably mounted in the water tub so as to be inclined downwardly rearward and having a rear wall; and a turbidity sensor detecting a turbidity of wash liquid in the water tub and disposed on a lower inside face of the rear wall of the water tub so as to be opposed to the rear wall of the rotating tub, the turbidity sensor including a light emitting element and a light detecting element.

2. The drum type washing machine according to claim 1, wherein the lower inside face of the rear wall of the water tub is formed with a hollow outward protrusion in which the turbidity sensor is disposed.

3. The drum type washing machine according to claim 1, wherein the outer cabinet has a rear wall with an inspection hole formed therethrough so as to correspond to the turbidity sensor and with a lid mounted thereon so as to close and open the inspection hole, and wherein the turbidity sensor is detachably attached through the inspection hole to the rear wall of the water tub.

4. The drum type washing machine according to claim 1, wherein the turbidity sensor is located on the rear wall of the water tub so as to be circumferentially displaced from a lowest portion of the rear wall of the water tub, and wherein the turbidity sensor carries out a detecting operation when the rotating tub is rotated in the direction of displacement of the turbidity sensor.

* * * * *